United States Patent [19]

Metzelder

[11] 4,437,817

[45] Mar. 20, 1984

[54] TWO CYLINDER VISCOUS MATERIAL PUMP

[75] Inventor: Wolfgang Metzelder, Ibbenbüren, Fed. Rep. of Germany

[73] Assignee: Friedrich Wilh. Schwing GmbH, Herne, Del.X

[21] Appl. No.: 515,450

[22] Filed: Jul. 20, 1983

Related U.S. Application Data

[63] Continuation of Ser. No. 205,296, Nov. 10, 1980, abandoned.

[30] Foreign Application Priority Data

Jun. 27, 1980 [DE] Fed. Rep. of Germany ..... 3024139

[51] Int. Cl.[3] ..... F04B 39/08

[52] U.S. Cl. ..... 417/507; 417/516; 417/900

[58] Field of Search ..... 419/516, 517, 518, 519, 419/900, 507

[56] References Cited

U.S. PATENT DOCUMENTS

| | | | |
|---|---|---|---|
| 2,448,104 | 8/1948 | Longenecker | 417/519 |
| 3,172,363 | 3/1965 | Bennett et al. | 417/900 X |
| 3,327,641 | 6/1967 | Klosterman | 417/900 X |
| 3,639,086 | 2/1972 | Robbins | 417/454 |
| 3,647,325 | 3/1972 | Johnson | 417/900 |
| 3,774,633 | 11/1973 | Decker | 137/493.8 |
| 4,067,666 | 1/1978 | Richards | 417/900 |

FOREIGN PATENT DOCUMENTS

| | | | |
|---|---|---|---|
| 241274 | 11/1964 | Fed. Rep. of Germany . | |
| 1917888 | 11/1969 | Fed. Rep. of Germany . | |
| 1803819 | 6/1970 | Fed. Rep. of Germany . | |
| 1363612 | 1/1964 | France | 417/900 |

*Primary Examiner*—Richard E. Gluck
*Assistant Examiner*—Peter M. Cuomo
*Attorney, Agent, or Firm*—Andrus, Sceales, Starke & Sawall

[57] ABSTRACT

A two-cylinder viscous material pump has parallel axis, conveying cylinders mounted in a frame work. The conveying cylinders alternately suck in the viscous material through an inlet valve housing from a reservoir and press it out, in the following stroke, through an outlet valve housing. In each valve housing, a pressure controlled valve with a valve drive cylinder is provided for each conveying cylinder, and the inlet and outlet valve drive cylinders are arranged axis parallel. The conveying cylinders as well as the inlet and outlet valve drive cylinders are arranged one above the other and the reservoir (41) is mounted laterally on the inlet valve housing with a suction bend.

6 Claims, 3 Drawing Figures

TWO CYLINDER VISCOUS MATERIAL PUMP

Figure 1:
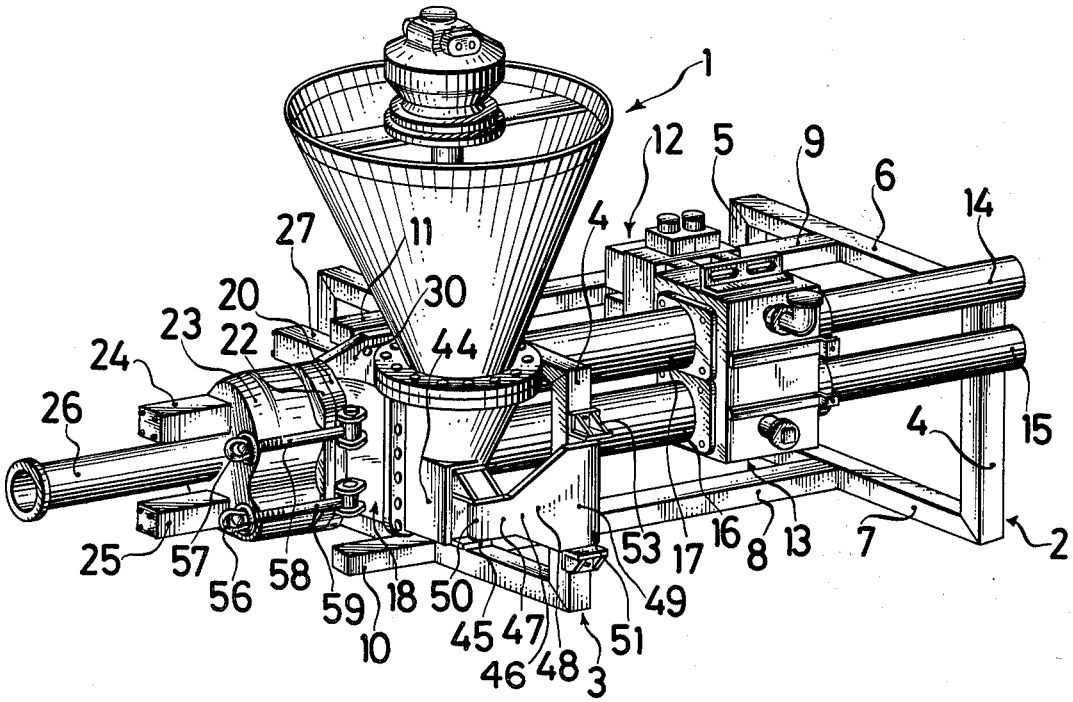

This application is a continuation of Ser. No. 205,296 filed Nov. 10, 1980, now abandoned.

The present invention relates to a two-cylinder viscous material pump. The parallel axis, conveying cylinders of the pump, that are preferably mounted in a frame work, alternately suck in a pasty to pulpy viscous material through an inlet valve housing common to them and connecting them with a reservoir or delivery conduit and press out, in the respective following stroke, through a thereon connected outlet valve housing into a pressure conduit. In each valve housing, a pressure controlled valve with a valve drive cylinder is provided for each conveying cylinder and the inlet and outlet valve cylinders are respectively arranged axis parallel.

The two-cylinder viscous material pump according to the invention is suited for the conveying of the most diverse viscous materials because its valve system precludes a wear producing short circuit between the suction and pressure areas through its four pressure controlled valves. These are constructed for example as plunger or disc seat valves and with valves actuated with a hydraulic pressure means can control the size of the cross-section through which the medium being pumped flows to an appropriate flow favoring form. Examples of viscous materials that can be conveyed with two-cylinder viscous material pumps according to the invention are thermally conditioned sludge from clarifiers, filter cakes in food apparatus, in particular in the sugar industry, flotation tailings in coal and ore mines, and bentonite-concrete mixtures for support extrusions.

The invention is derived from a previously known two-cylinder viscous material pump, in which the conveying cylinders are arranged horizontally next to each other so that the viscous material being conveyed can enter in the inlet valve housing from above. In this connection, the inlet valve seats lie in a horizontal plane above the conveying cylinders, while the vertically standing arranged inlet valve drive cylinders are arranged under the conveying cylinders. The outlet valve housing sits on the front face of the inlet valve housing with the horizontally arranged outlet valve drive cylinders, that enclose the pipe of the pressure conduit. With this arrangement the suctioning of the viscous material functions of course unobjectionably; the reservoir or the supply conduit connected usually with a hose pipe, however, considerably enlarges the necessary construction height of the pump.

Particularly with strongly abrasive viscous materials, for example, with beneficiation tailings with their corresponding additional components there results the necessity of frequently disassembling the valve drive cylinders, in order to replace different parts of the valves in the housings. Depending on the size of the reservoir or the pressure supply conduit considerable space is required for the mounting and dismounting of the pumps, that in narrow construction spaces or underground is frequently not available, so that the use of such two-cylinder viscous material pumps can be lost. Beyond that under these circumstances the dismounting of the inlet valve drive cylinders, in particular, is inordinately difficult.

The present invention has as its object to reduce the construction height of a two-cylinder viscous material pump and to improve the ease of repair of such pumps in particular under confined spatial conditions, without, on the other hand, adversely affecting the functional proficiency of the pumps.

According to the invention, this object is achieved in that the conveying cylinders, as well as the inlet and outlet valve drive cylinders are arranged one above the other and the reservoir or the supply conduit is connected with a suction bend laterally on the suction valve housing.

When one arranges the supply cylinders one above the other, one shifts the suction openings to one or the other side of the pumps; the thereby, of course, impeded supply of the viscous material one equalizes, according to the invention, through the suction bend, the free opening of which can lie in the plane of the suction openings of the inlet valve housing. Thus one simultaneously with the shifting of the suction openings also shifts the inlet valve cylinders on the suction openings of the inlet valve housing to the housing side so that one can reduce considerably the construction height of the pump defined through the upper edge of the reservoir or the supply conduit. According to the invention through the one above the other arrangement of the inlet valve cylinders and accordingly also of the suction openings controlled from same as well as the outlet valve cylinders and accordingly also the outlet openings of the outlet valve housing belonging to same, the flow favoring configuration of the parts through which the medium flows is maintained so that altogether the functional proficiency of the pump is not adversely effected. On the other hand, one can, in particular, easily dismount the inlet valve cylinders under confined spatial conditions because of their lateral arrangement.

Preferably, and according to a further feature of the invention, one assembles the arrangement so that the conveying and valve drive cylinders are arranged in a respective vertical plane one above the other. One maintains then a 90° suction bend.

With the one or the other arrangement one can articulate the outlet valve housing on the inlet valve housing with a hinge joint, the pivot axis of which is oriented parallel to the plane that contains the outlet valve drive cylinders. This articulation facilitates the opening of the outlet valve housing, that is necessary in order particularly to reach the seats and the closing bodies of the valves.

Accordingly, it is also advantageous pursuant to a further feature of the invention to fasten the suction bend on a link, the pivot axis of which is arranged parallel to the plane that contains the inlet valve drive cylinder. Then one can after loosening corresponding parts, rotate the suction bend to the side, when one carries out repair work on the inlet valves.

Of particular advantage is the possibility with the invention of alternatively so arranging the two-cylinder viscous material pump that the suction openings of the inlet valve housing lie laterally right or laterally left in the conveying direction, since one can thereby further reduce the requirements of the space of the pump. Expediently that occurs in that the frame is at least symmetrical to a horizontal plane extending through it. Then one can arrange the pump in the frame in two positions rotated 180°.

Figure 2:
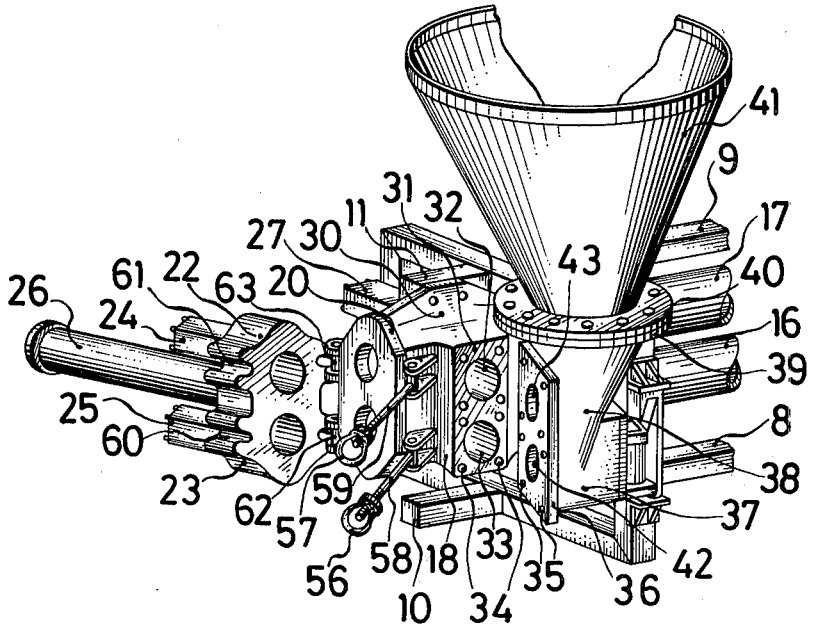
Figure 3:
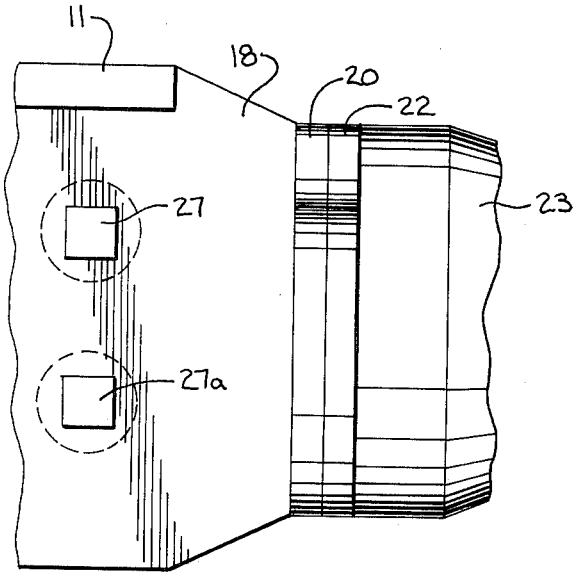

The details, further features and other advantages of the invention will be apparent from the following description of an exemplary embodiment with the aid of the figures of the drawing; in which FIG. 1 in perspective view a two-cylinder viscous material pump according to the invention essentially from the side, FIG. 2 in a view corresponding to FIG. 1, but however, broken, showing the suction and pressure sides of the pump with open valve housings, and FIG. 3 is a side view showing the inlet valves.

In the following, the individual components of the two-cylinder viscous material pump 1 to be explained are assembled in a frame, that according to the illustrative exemplary embodiment is formed of two congruent frame members 2 and 3, that are composed, respectively, out of parallel vertical part members 4 and 5 and associated parallel horizontal part members 6 and 7. These frame part members are cut on the bevel and present a rectangular profile. The pair of frame members 2 and 3 are connected with each other through transverse members 8 and 9 that with the part lengths 10 and 11 extend beyond the plane of the forward frame member 3. The transverse members 8 and 9 serve selectively for the attachment of the control and connection housings 12, 13, for the pump drive. These are formed of two axis parallel hydraulically actuatable drive cylinders 14, 15, that are connected on the back side of the two conveying cylinders 16, 17 of the pump in aligned arrangement with conveying cylinders. The free ends of the conveying cylinders 16 and 17 end in an inlet valve housing 18, the front surface of which is provided with a flange 20. This allows connection with the flange 22 of an outlet valve housing 23. The outlet valve housing carries outlet valve drive cylinders 24 and 25 and both cylinders 24 and 25 surround a pipe support 26, that forms the beginning of a not-disclosed pressure conduit. The inlet valve housing 18 has for its part two parallel arranged inlet valve drive cylinders 27, 27*a* shown in FIG. 3.

As will be apparent from the showing of FIG. 1, the pair of conveying cylinders 16, 17, as well as the pairs of inlet and outlet valve drive cylinders 24, 25; 27, 27*a* are arranged one above the other.

As one can appreciate particularly from the showing of FIG. 2, the inlet valve housing 18 is bolted on the transverse extension 11 by means of a flange 30 formed on its upper side. On one of its vertical sides 31 emerges the inlet openings 32, 33, that for their part are surrounded with four threaded bores 34. These can be aligned with corresponding bores 35 in the connection flange 36 of a housing 37 that comprises in essence a 90° suction bend 38. The free end of the suction bend has a mounting flange 39 with bores located on a circle for mounting bolts, with which a corresponding flange 40 can be fastened, that forms the lower mounting of a funnel-shaped reservoir 41.

As is apparent from the FIG. 2, openings 42, 43 are found in the flanged part 36 of housing 37 that can be aligned with the corresponding openings 32, 33 in the flow passage formed in the inlet valve housing 18 when the flange 36 is bolted with the housing 18, according to view of FIG. 1.

The housing 37 has on its side lying opposite the flange 36 a formed projection 44 with a forked bracket 45 for the mounting of a link 46. The link has a forward essentially rectangular part 47, a trapezoidal part 48 fastened thereon, and a widened rectangular part 49. The parts 47 and 49 are connected with their free ends on the vertical rotating axis of pivots 50 and 51, whose rotating axes run vertical. The rotating axis of the pivot 51 is held in a fork formed bracket 53, that is fastened on the vertical frame element 4 of the forward frame element 3.

According to the illustrated exemplary embodiment, the conveying cylinders 16, 17, and the inlet and outlet valve drive cylinders 24, 25; and 27, 27*a* are arranged vertically one above the other. When one wants to obtain access to the seats of the not-disclosed valve body one can, after loosening the flange bolts, swing the housing 37 out by means of the link 46, as shown in FIG. 2. Additionally, one can after loosening of the pair of lug nuts 56, 57 on the ends of both threaded swivel tie bars 58, 59 that are pivotally arranged in a vertical axis along the flange 20 of the inlet valve housing 18, loosen the tie bars 58 and 59 on their guides 60 and 61 on a side of the mounting flange 22 of the output valve housing 23. Then the output valve housing can tilt with likewise vertical pivot axes about two hinges 62, 63 lying one above the other, as is illustrated in FIG. 2.

As the frame 2 is formed symmetrically to its middle plane, one can mount the pump described above in the frame also in a position tilted 180° from the disclosed position, by means of which the longitudinal arrangement of the opening 32, 33 is arranged to the right side.

In the operation of pump 1, the pistons in conveying cylinders 16, 17 alternately advance and retract. When the piston in one conveying cylinder, for example 17, retracts, the associated inlet valve 27 is opened to permit the piston to suck material from reservoir 41 into cylinder 17. The associated outlet valve 24 is closed to prevent withdrawing material from pipe 26. At the same time, the piston in the other conveying cylinder, for example 16, is advancing. The associated intake valve 27*a* is closed to prevent return of the material to reservoir 41. Outlet valve 25 is opened to supply material to pipe 26.

I claim:

1. A viscous material pump comprising:

a pair of conveying cylinders (16, 17), one of said conveying cylinders being arranged above the other in a common plane with axes of the cylinders, along which the material is conveyed, being horizontal and lying parallel to each other;

an inlet valve housing (18) connected to said conveying cylinders;

a viscous material supply source (41) mounted on a side of said inlet valve housing laterally of the common plane of said conveying cylinders;

an outlet valve housing (23) connected intermediate said inlet valve housing (18) and a delivery conduit (26) for conveying the viscous material and extending horizontally from said outlet valve housing;

a pair of inlet valve means (27, 27*a*) mounted on said inlet valve housing for controlling the passage of the viscous material from said supply source (41) to said conveying cylinders (16, 17), said inlet valve means extending horizontally from a side of said inlet valve housing opposite that on which said viscous material supply source is mounted and extending normal to the conveying axes of the cylinders, one of said inlet valve means being arranged above the other on said inlet valve housing in a common plane; and a pair of outlet valve means (24, 25) mounted on said outlet valve housing (23) adjacent said delivery conduit for controlling the passage of viscous material to said delivery conduit (26), said outlet valve means (24, 25) extending horizontally from said outlet valve housing parallel to said conveying axes, one of said outlet valve means being arranged above the other in a common plane with said delivery conduit extending between said pair of outlet valve means.

2. The viscous material pump according to claim 1 wherein the ones of said conveying cylinders, inlet valve means, and outlet valve means are arranged above the others of the conveying cylinders, inlet valve means and, outlet valve means, respectively, in vertical common planes.

3. The viscous material pump according to claim 1 or 2 wherein said outlet valve housing (23) is articulated on said inlet valve housing (18) by means of a hinge joint (62, 63), the pivot axis of said joint being oriented parallel to the common plane containing said outlet valve means (24, 25).

4. The viscous material pump according to claim 1 wherein said viscous material supply source is mounted on said side of said valve inlet housing through a suction bend (38).

5. The viscous material pump according to claim 4 wherein said suction bend (38) is articulated on said inlet valve housing, said suction bend being fastened on a link (46) pivoted on said inlet valve housing, the pivot axis of said link being oriented parallel to the common plane containing said inlet valve means (27).

6. The viscous material pump according to claim 1 further including a mounting frame (2) for the conveying cylinders, viscous material supply source, valve housings, and valve means of said pump, said mounting frame being symmetrically formed with respect to a horizontal plane extending through it.

* * * * *